US005601446A

United States Patent [19]

Wright

[11] Patent Number: 5,601,446

[45] Date of Patent: Feb. 11, 1997

[54] CONNECTOR LATCH AND ASSEMBLY

[75] Inventor: John O. Wright, York, Pa.

[73] Assignee: Osram Sylvania Inc., Danvers, Mass.

[21] Appl. No.: 553,162

[22] Filed: Nov. 7, 1995

[51] Int. Cl.[6] ..... H01R 13/627

[52] U.S. Cl. ..... 439/357; 439/369

[58] Field of Search ..... 439/345, 350–358, 439/368–369

[56] References Cited

U.S. PATENT DOCUMENTS 5,232,378 8/1993 Weingartner ..... 439/354

5,288,243 2/1994 Mergless ..... 439/357

5,308,261 5/1994 Kightlinger ..... 439/358

5,409,395 4/1995 Okada ..... 439/354

*Primary Examiner*—Khiem Nguyen

[57] ABSTRACT

A connector latch is provided which includes an inner member having protuberances which extend therefrom and a concentric outer sleeve which may be reciprocated relative to such inner member to lock the protuberances in place relative to corresponding connector openings to lock mated connectors together. A connector assembly which includes such a connector latch is also provided.

20 Claims, 6 Drawing Sheets

CONNECTOR LATCH AND ASSEMBLY

TECHNICAL FIELD

The present invention relates to a connector latch for use with two mating connectors. The present invention also relates to a connector assembly which includes such a connector latch.

BACKGROUND ART

A typical connector assembly includes a male connector generally in the form of a plug and a female connector generally in the form of a ferrule which forms a socket. In use, the male connector is plugged into the female connector to effect a mechanical and electrical connection between the two. Typically, a cable in the form of a coaxial cable is electrically and mechanically attached to one of the connectors such as the male connector, and the other connector, such as the female connector, is electrically and mechanically attached to another coaxial cable or to a circuit such as a circuit on a printed circuit board. An example of such a connector assembly is a typical antenna connector assembly for antenna cables such as those used in the automobile industry for radios. Such a connector assembly typically includes a male connector and a female connector which are mechanically and electrically attached to coaxial cables and in use are mechanically and electrically connected to each other.

In such prior art devices, the lack of satisfactory tactile feedback makes it difficult to know when a suitable connection has been made. In addition, if the connectors are not locked together there may be a tendency for the connectors to be inadvertently disengaged. Connector latches known in the art for use in locking together male and female connectors tend to be bulky and tend to require unusual effort to separate once engaged. Such connector latches also tend to be expensive.

DISCLOSURE OF INVENTION

It is an object of the present invention to provide a connector latch which provides improved locking of one connector to another.

It is a further object of the present invention to provide such a connector latch which is simple in construction and use and inexpensive to fabricate.

It is another object of the present invention to provide such a connector latch which occupies little additional space beyond that occupied by the connectors to which it is attached.

Yet another object of the present invention is to provide such a connector latch which requires little effort to engage and disengage.

It is another object of the present invention to provide such a connector latch which provides tactile feedback during assembly.

Another object of the present invention is to provide a connector assembly which includes such a connector latch.

This invention achieves these and other objects, in one aspect of the invention, by providing a connector latch which comprises an inner member having a bore which extends therethrough along a longitudinal axis from a first end to an opposite second end. The inner member comprises a first segment and an opposite second segment, the opposite second segment comprising a base portion. The inner member also comprises a plurality of first legs which extend in the direction of the longitudinal axis from the base portion towards the first end. At least one first leg comprises a first protuberance which protrudes towards the longitudinal axis. Such first protuberance is movable towards and away from the longitudinal axis. Each first leg is spaced from an adjacent first leg in a circumferential direction relative to the longitudinal axis to provide a respective first opening between adjacent legs. An outer sleeve is provided which is concentric with the inner member and includes an inner surface adjacent an outer surface of the inner member. The outer sleeve is movable in the direction of the longitudinal axis towards and away from the first protuberance to a first position and second position, respectively. A connector assembly which includes such a connector latch is also provided.

BRIEF DESCRIPTION OF THE DRAWINGS

This invention may be clearly understood by reference to the attached drawings wherein like parts are designated by like reference numerals and in which.

BEST MODE FOR CARRYING OUT THE INVENTION

Figure 1:
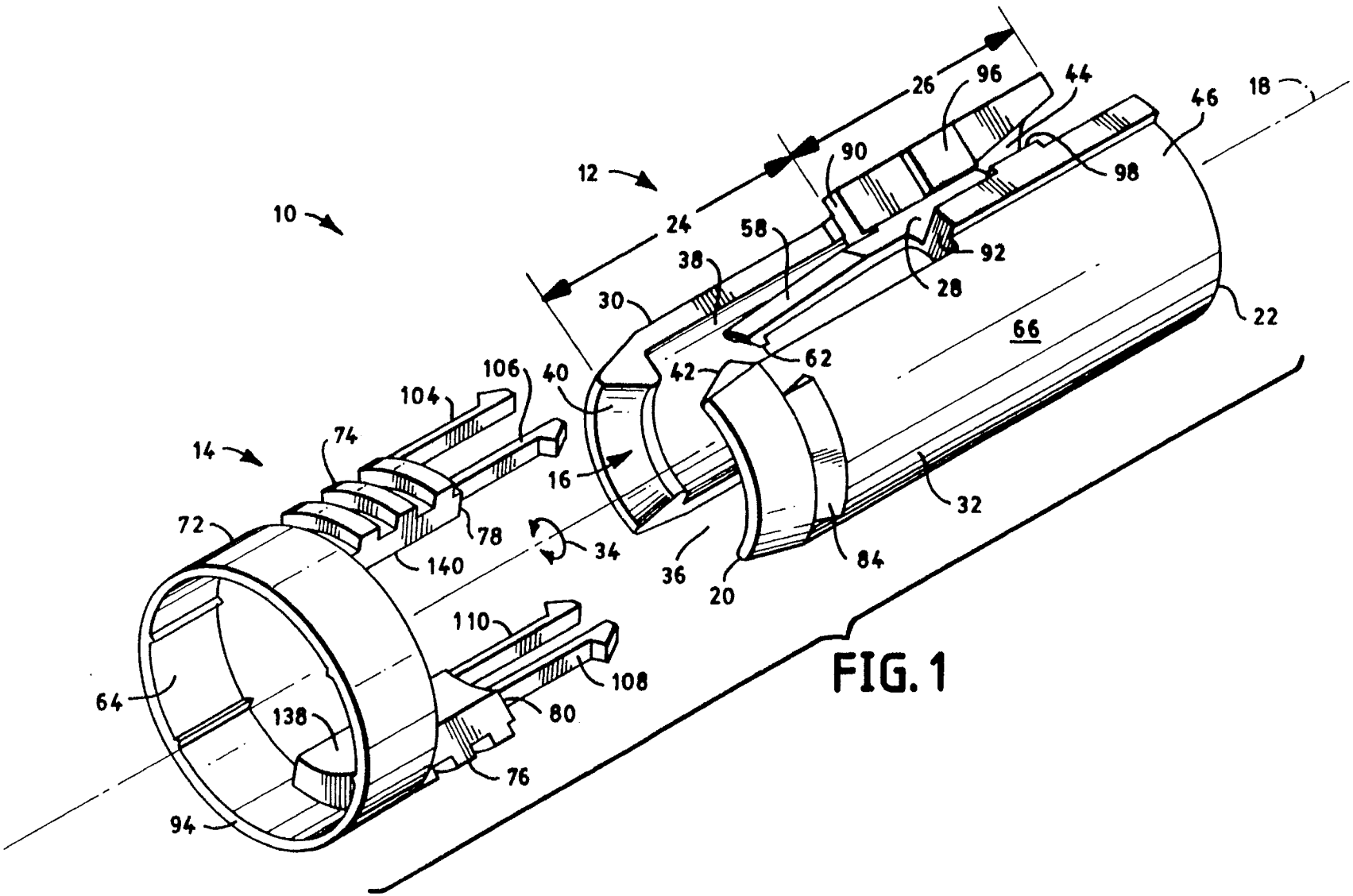
FIG. 1 is an exploded perspective view of a connector latch embodying the present invention.
Figure 2:
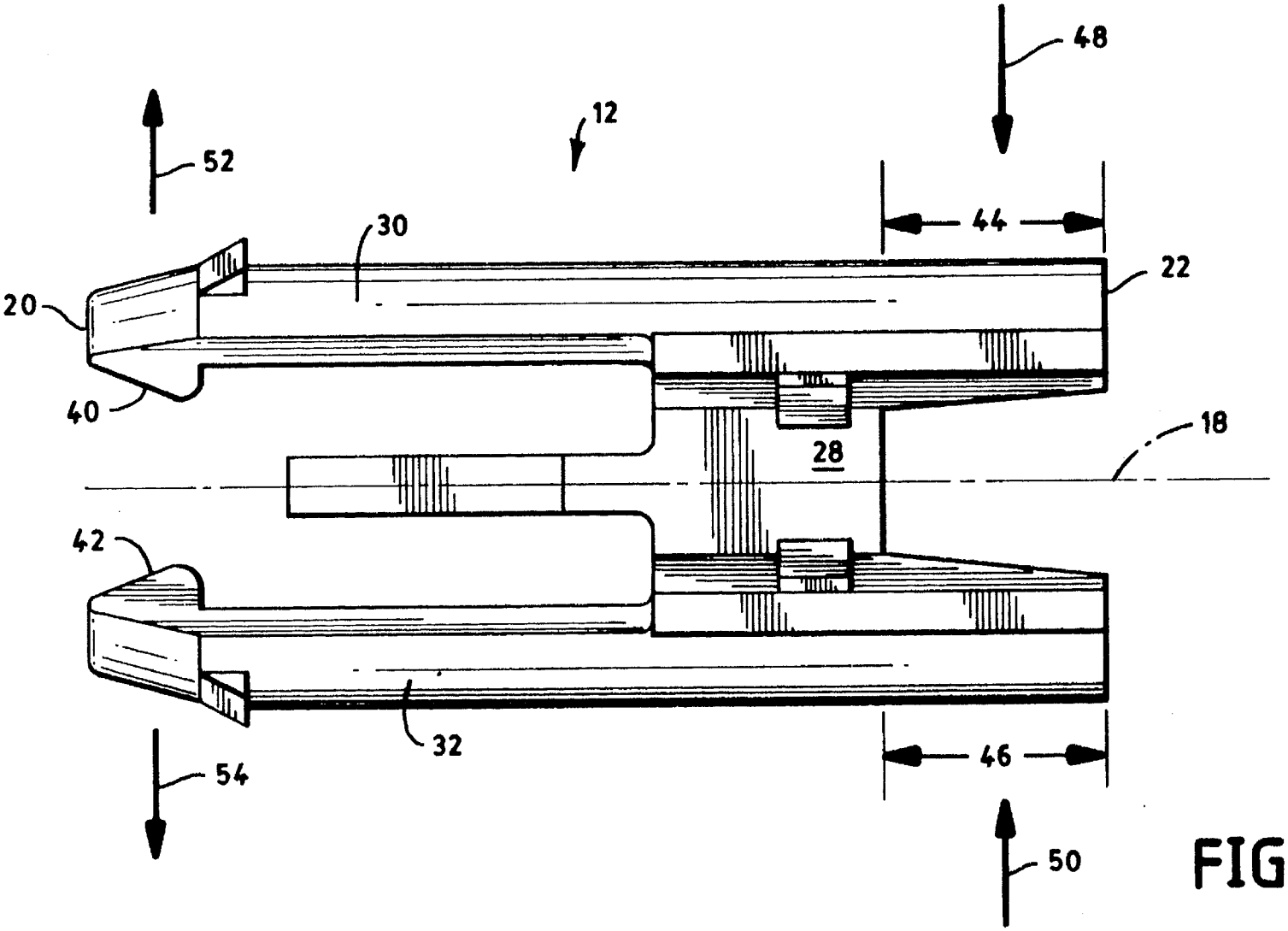
FIG. 2 is a top view of the connector latch of FIG. 1 with the outer sleeve 14 removed.

For a better understanding of the present invention, together with other and further objects, advantages and capabilities thereof, reference is made to the following disclosure and appended claims taken in conjunction with the above-described drawings.

Referring now to the drawings with greater particularity, FIGS. 1 to 4 depict a connector latch 10 which comprises an inner member 12 and an outer sleeve 14. In the preferred embodiment, inner member 12 and outer sleeve 14 are molded from a plastic material which is resilient and flexible.

The inner member 12 includes a bore 16 which extends therethrough along a longitudinal axis 18 from a first end 20 to an opposite second end 22. The inner member 12 comprises a first segment 24 and an opposite second segment 26. Segment 26 includes a base portion 28. In the embodiment depicted in FIGS. 1 to 4, only the top portion of the inner member 12 is visible. However, it should be noted that in this embodiment, the bottom portion is identical to the top portion as is apparent from FIGS. 3 and 4 which depict top and bottom views of FIG. 1, respectively.

The inner member 12 comprises a plurality of first legs which extend in the direction of the longitudinal axis 18 from the base portion 28 towards first end 20. For example, in the embodiment of FIGS. 1 to 4, there are two first legs 30 and 32 which extend in the direction of longitudinal axis 18 from base portion 28 towards first end 20. Each first leg is spaced from an adjacent first leg in a circumferential direction 34 relative to longitudinal axis 18 to provide a respective opening between adjacent legs. For example, legs 30 and 32 are spaced from each other in direction 34 to provide openings 36 and 38 between respective adjacent legs. At least one first leg comprises a first protuberance which protrudes towards the longitudinal axis 18. Such protuberance is movable towards and away from longitudinal axis 18 as described hereinafter. For example, in the embodiment of FIGS. 1 to 4, each first leg 30 and 32 includes a respective first protuberance 40 and 42. First protuberances 40 and 42 are positioned opposite to each other relative to longitudinal axis 18.

In the embodiment of FIGS. 1 to 4, first leg 30 and first leg 32 are pivotal relative to base portion 28 towards and away from the longitudinal axis 18 to respectively move first protuberance 40 and first protuberance 42 towards and away from such longitudinal axis. Since first protuberances 40 and 42 are positioned opposite to each other, such pivotal motion will cause first protuberances 40 and 42 to correspondingly move towards and away from each other. To facilitate such pivotal movement first leg 30 and first leg 32 include respective portions 44 and 46 which extend in the direction of longitudinal axis 18 from base portion 28 away from first end 20. Due to the flexible nature of the material from which inner member 12 is fabricated the first portion 44 and second portion 46 are movable towards and away from the longitudinal axis 18 to respectively pivot first protuberance 40 and first protuberance 42 away from and towards longitudinal axis 18. For example, and with reference to FIG. 2, grasping portions 44 and 46 between the forefinger and thumb and exerting a force in the direction of respective arrows 48 and 50 will pivot legs 30 and 32, and therefore protuberances 40 and 42, about base portion 28 in the direction of respective arrows 52 and 54. Due to the resilient nature of the material from which the inner member 12 is fabricated, releasing such force will permit portions 44 and 46 and the legs 30 and 32, and therefore protuberances 40 and 42, to pivot back to the position which they had before such force was applied.

If desired, the inner member 12 may further comprise a plurality of second legs, which extend in the direction of longitudinal axis 18 from base portion 28 towards the first end 20, each of which comprises a second protuberance which protrudes towards the longitudinal axis 18 and is movable towards and away from such axis. For example, in the embodiment of FIGS. 1 to 4 the inner member 12 includes resilient and flexible second legs 56 and 58 which are positioned respectively in openings 36 and 38. Second leg 56 includes a second protuberance 60 and second leg 58 includes a second protuberance 62. Protuberances 60 and 62 are spaced from each other in circumferential direction 34 and are positioned opposite to each other relative to longitudinal axis 18 such that movement of legs 56 and 58 towards and away from axis 18 causes protuberances 60 and 62 to move towards and away from each other, respectively. The function of protuberances 60 and 62 will be described hereinafter.

Figure 3:
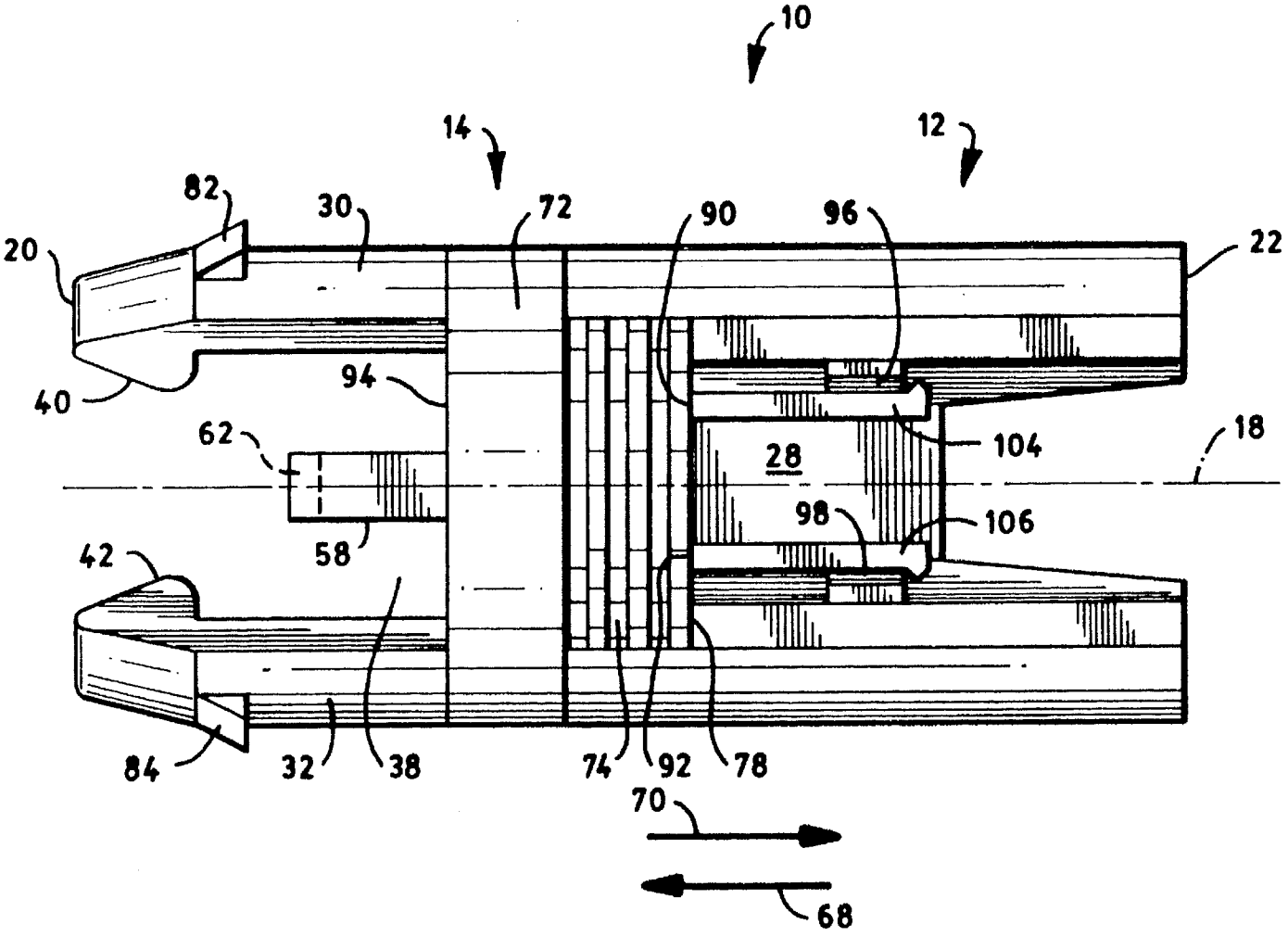
FIG. 3 is a top view of the connector latch of FIG. 1.
Figure 4:
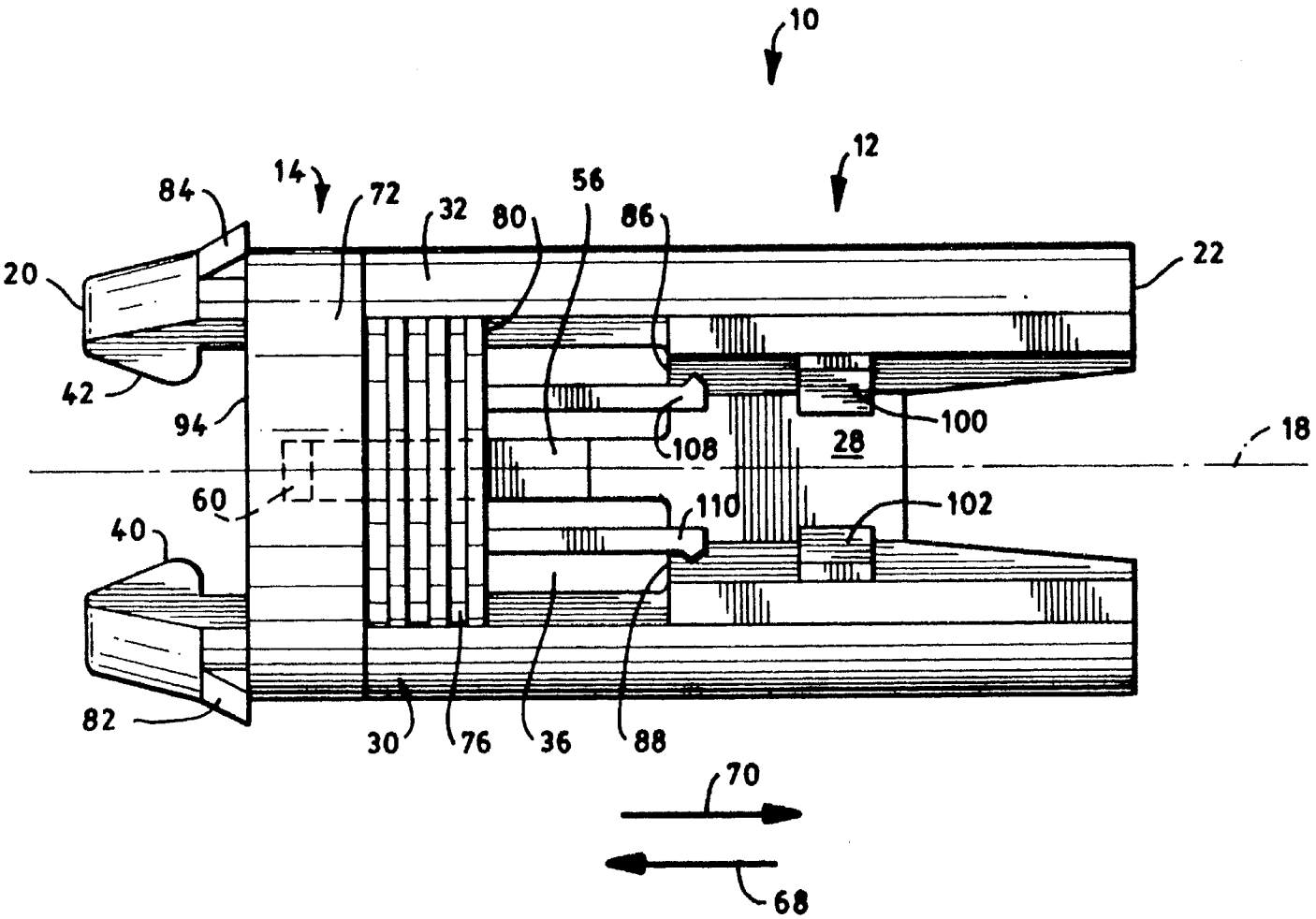
FIG. 4 is a bottom view of the connector latch of FIG. 1.

Outer sleeve 14 is concentric with the inner member 12 and includes an inner surface 64 which is adjacent an outer surface 66 of the inner member. In the embodiment of FIGS. 1 to 4, the outer sleeve 14 includes an open ended cylindrical member 72 into which inner member 12 is inserted such that the outer sleeve may be reciprocated relative to the inner member in directions 68, 70. As best seen in FIGS. 3 and 4, the outer sleeve 14 is movable in the direction 68 of the longitudinal axis 18 towards the first protuberances 40 and 42 to a first position (FIG. 4) and in the direction 70 of the longitudinal axis 18 away from the first protuberances 40 and 42 to a second position (FIG. 3). The cylindrical member 72 includes appendages 74 and 76 extending therefrom in the direction of longitudinal axis 18 from the cylindrical member towards the end 22 of the inner member 12. Appendages 74 and 76 include respective abutment surfaces 78 and 80. Legs 30 and 32 include respective distal ends having respective outer surfaces which comprise respective ribs 82 and 84 each of which extends away from longitudinal axis 18. The outer sleeve 14 is retained between the ribs 82, 84 and the end 22 of the inner member 12 as best seen in FIGS. 3 and 4. To this end, the base portion 28 comprises stop surfaces 86, 88 and 90, 92 adjacent respective openings 36 and 38. As depicted in FIGS. 3 and 4, outer sleeve 14 may be moved in direction 68 until the edge 94 of the cylindrical member 72 engages the ribs 82 and 84, and may be moved in opposite direction 70 until the abutment surfaces 78 and 80 engage respective surface pairs 90, 92 and 86, 88.

In the preferred embodiment, the base portion includes at least one latch member and the outer sleeve includes at least one mating latch member, each latch member engaging a respective mating latch member when the inner sleeve is in the position depicted in FIG. 3, and disengaging a respective mating latch member when the inner sleeve is in the position depicted in FIG. 4. In the preferred embodiment, the base portion 28 comprises a first latch member positioned at an outer surface adjacent opening 38 and a second latch member positioned at an outer surface adjacent opening 36, the first latch member being positioned opposite the second latch member relative to longitudinal axis 18. In such embodiment, outer sleeve 14 comprises a first mating latch member aligned with the first latch member and a second mating latch member aligned with the second latch member. For example, in the preferred embodiment, the first latch member comprises a pair of detents including a first detent 96 and a second detent 98 spaced from each other in circumferential direction 34. Similarly, the second latch member comprises a pair of detents including a first detent 100 and a second detent 102 spaced from each other in circumferential direction 34. The first mating latch member comprises a pair of catch members extending from appendage 74 and including a first catch member 104 and second catch member 106 spaced from each other in circumferential direction 34. Similarly, the second mating latch member comprises a pair of catch members extending from appendage 76 and including a first catch member 108 and second catch member 110 spaced from each other in circumferential direction 34. Each pair of catch members engage a respective pair of detents when the outer sleeve is in the position depicted in FIG. 3 and disengage a respective pair of detents when the outer sleeve is in the position depicted in FIG. 4.

Figure 5A:
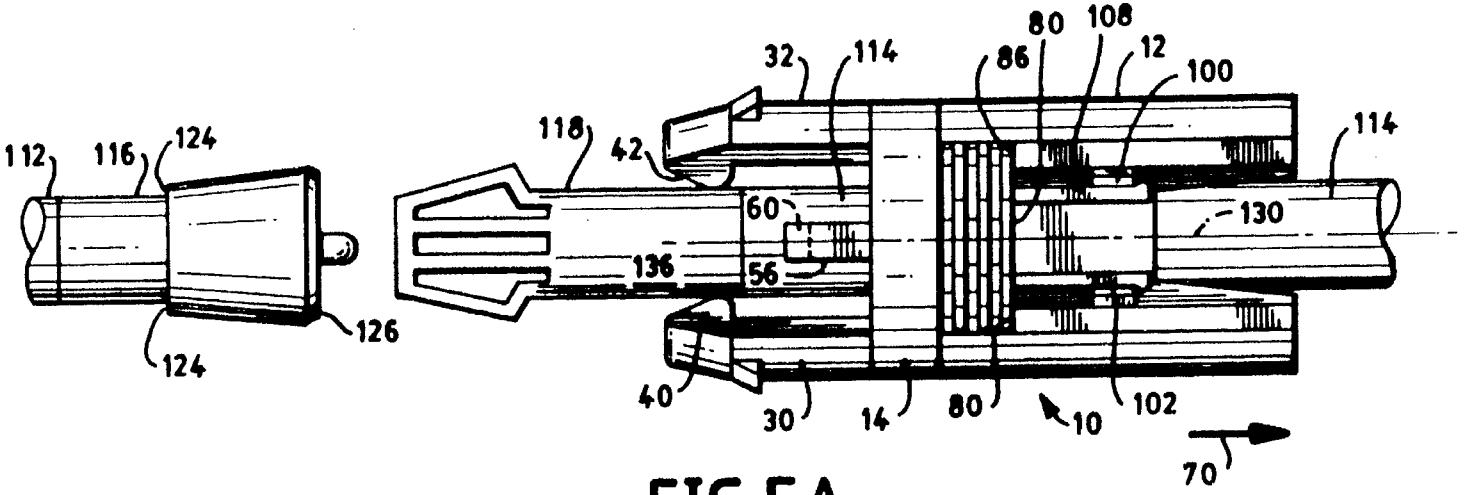
FIGS. 5A, 5B, 5C, 5D depict an operational sequence of the assembly of a connector assembly of the present invention, including the connector latch of FIG. 1, viewing such connector latch from the bottom as depicted in FIG. 4.

The use of the connector latch will now be explained with reference to FIGS. 1 to 5 (5A–5B). FIG. 5A depicts two lengths 112, 114 of conventional coaxial cable having conventional connectors 116, 118 electrically and mechanically attached to respective ends thereof. By way of example, connector 116 is a male connector and connector 118 is a female connector. The end portion 120 of male connector 116 is formed with a larger diameter than the remaining portion 122 to thereby provide an abutment surface 124 spaced from end 126. The coaxial cable 114 extends through bore 16 of the connector latch 10 so that the connector latch is supported by such coaxial cable. At this time, the outer sleeve 14 has been moved in the direction 70 so that the outer sleeve does not interfere with the movement of the legs 30, 32 and 56, 58, and their respective first protuberances 40, 42 and second protuberances 60, 62, towards and away from longitudinal axis 18. In particular, the outer sleeve 14 has been moved in the direction 70 to the extent that the abutment surfaces 78, 80 engage respective surface pairs 90, 92 and 86, 88. In such position the catch members 104, 106 and 108, 110 snap into place against respective detents 96, 98 and 100, 102 to retain the outer sleeve 14 in place relative to the inner member 12, the outer sleeve 14 being sufficiently spaced from end 20 of inner member 12 so as not to interfere with movement of legs 30, 32 and 56, 58 relative to longitudinal axis 18. The female connector 118 comprises a plurality of lengths 128 which extend in the direction of axis 130 of the female connector 118, each length 128 being spaced from an adjacent length 128 in a circumferential direction relative to axis 130 to provide spaces 132 between adjacent lengths 128.

Figure 5B:
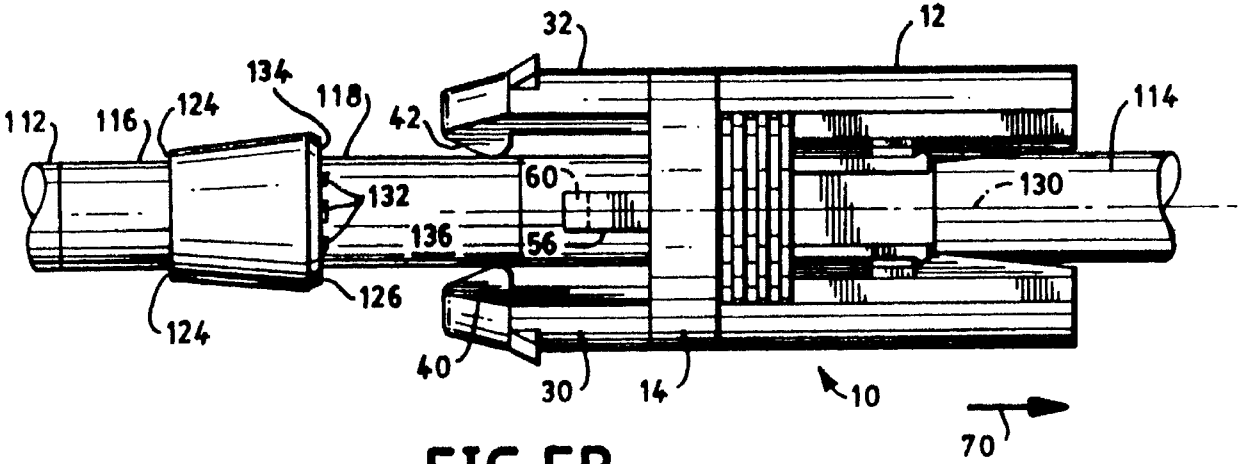
Figure 5C:
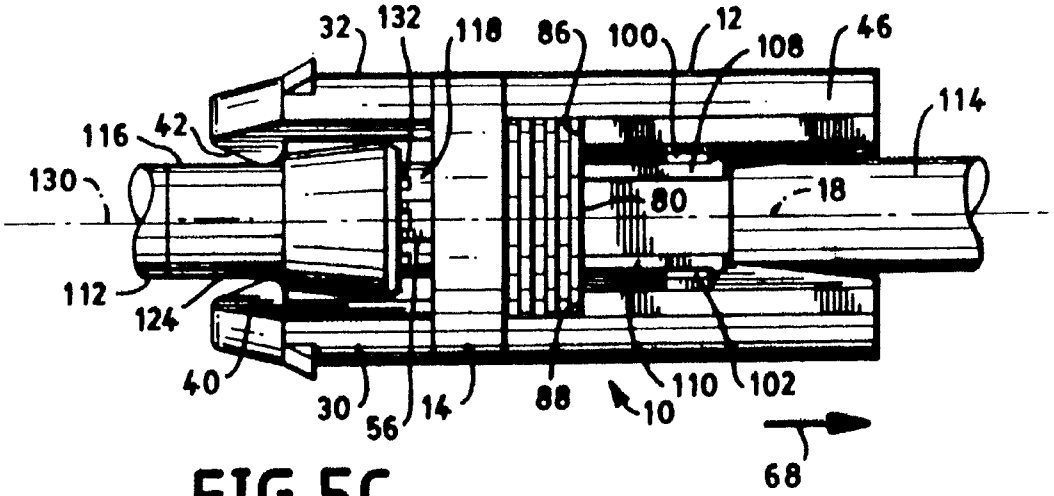
Figure 5D:
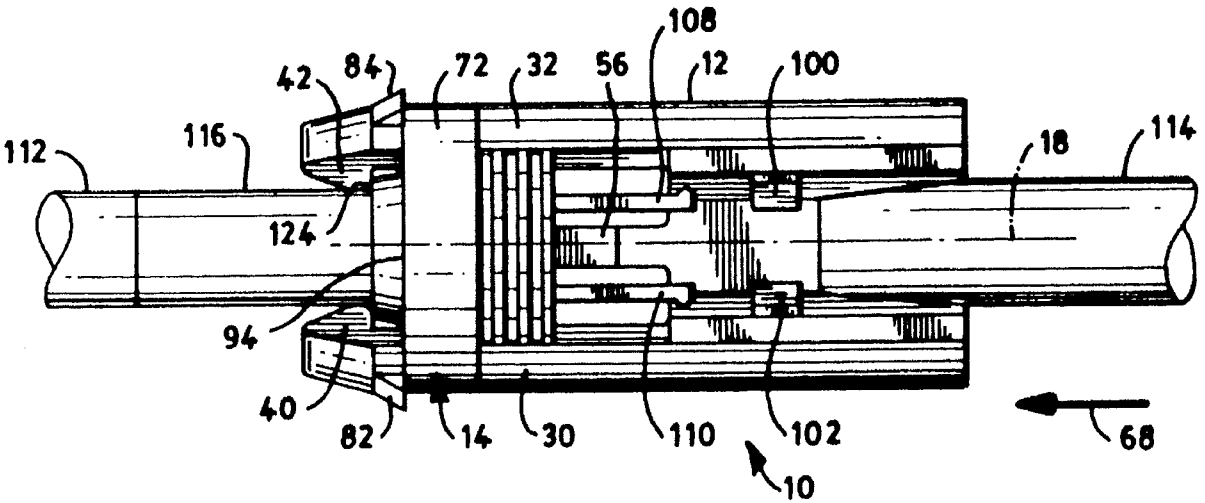

FIG. 5B depicts the male connector 116 electrically and mechanically connected to the female connector 118, the lengths 128 being adjacent the end 126 of the male connector 116 and a portion 134 of each space 132 extending external of male connector 116.

After the male connector 116 has been connected to the female connector 118, the operator grasps portions 44 and 46 of the connector latch 10 between the forefinger and thumb and exerts a force in the direction of respective arrows 48 and 50 (FIG. 2) which causes protuberances 40 and 42 to pivot away from each other in the direction of respective arrows 52 and 54. At the same time, the connector latch 10 is moved in the direction 68 to the axial position depicted in FIG. 5C whereupon the operator releases his grasp of the portions 44 and 46 which allows protuberances 40 and 42 to spring back towards axis 18, the resilience of legs 30 and 32 urging respective protuberances 40, 42 against abutment surface 124. By dimensioning the legs 56, 58 such that the distance between protuberances 60 and 62 is less than the diameter of the connector 118, when the connector latch 10 is being so moved in the direction 68, the resilient legs 56 and 58, and therefore protuberances 60, 62, will be cammed away from axis 18 by the engagement of protuberances 60, 62 with outer surface 136 of female connector 118 until protuberances 60, 62 are aligned with a respective length 134 of a respective space 132, at which time the protuberances 60, 62 will spring into engagement with a respective length 134 of a respective space 132.

In order to prevent the protuberances 40, 42 and 60, 62 from inadvertently moving out of engagement with abutment surface 124 and spaces 132, respectively, the operator moves the outer sleeve 14 in the direction of arrow 68. To this end the operator may urge the distal ends of catch member 104, 106 and the distal ends of catch members 108, 110, towards each other so as to disengage such catch members from respective mating detents 96, 98 and 100, 102, and then move outer sleeve 14 in the direction 68 depicted in FIG. 5D. In particular, the outer sleeve 14 is moved in direction 68 until the edge 94 of the cylindrical member 72 of outer sleeve 14 abuts the ribs 82, 84 of respective legs 30, 32 of inner member 12. In such position, the protuberances 40, 42 are prevented from pivoting away from axis 18 and out of engagement with abutment surface 124 due to the fact that the legs 30, 32 will be prevented from moving away from axis 18 by engagement with inner surface 64 of cylindrical member 72. Similarly, the protuberances 60, 62 are prevented from pivoting away from axis 18 and out of engagement with spaces 132 due to the fact that the legs 56, 58 will be prevented from moving away from axis 18 by engagement with surfaces 138, 140 (FIG. 1) of respective appendages 76, 74.

The latch described herein provides a relatively inexpensive connector latch 10 and connector assembly which is simple in construction and use. The connector latch 10 occupies little additional space beyond that occupied by connectors 116, 118 and requires little effort to engage and disengage. When the protuberances 40, 42 and 60, 62 engage the abutment surface 124 and spaces 132, respectively, tactile feedback is provided to the operator indicating that the connectors 116, 118 are properly connected. Such engagement provides improved locking of connector 116 to connector 118.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector latch, comprising:

an inner member having a bore which extends therethrough along a longitudinal axis from a first end to an opposite second end, said inner member comprising a first segment and an opposite second segment, said opposite second segment comprising a base portion, said inner member comprising a plurality of first legs which extend in the direction of said longitudinal axis from said base portion towards said first end, at least one first leg of said plurality of first legs comprising a first protuberance which protrudes towards said longitudinal axis, said first protuberance being movable towards and away from said longitudinal axis, each first leg of said plurality of first legs being spaced from an adjacent first leg in a circumferential direction relative to said longitudinal axis to provide a respective first opening between adjacent first legs; and an outer sleeve concentric with said inner member and having an inner surface adjacent an outer surface of said inner member, said outer sleeve being movable in the direction of said longitudinal axis towards and away from said first protuberance to a first position and second position, respectively.

2. The connector latch of claim 1 wherein said plurality of first legs comprises two first legs including one first leg having one first protuberance and another first leg having another first protuberance, said one first protuberance being positioned opposite said another first protuberance relative to said longitudinal axis.

3. The connector latch of claim 2 wherein said one first leg and said another first leg are pivotal relative to said base portion towards and away from said longitudinal axis to respectively move said one first protuberance and said another first protuberance towards and away from said longitudinal axis.

4. The connector latch of claim 3 wherein said one first leg includes a first portion which extends in the direction of said longitudinal axis from said base portion away from said first end, and said another first leg includes a second portion which extends in the direction of said longitudinal axis from said base portion away from said first end, said first portion and said second portion being movable towards and away from said longitudinal axis to respectively pivot said one first protuberance and said another first protuberance away from and towards said longitudinal axis.

5. The connector latch of claim 1 wherein said inner member further comprises a plurality of second legs which extend in the direction of said longitudinal axis from said base portion towards said first end, each second leg of said plurality of second legs comprising a second protuberance which protrudes towards said longitudinal axis, each second protuberance being movable towards and away from said longitudinal axis, each second leg being positioned within a respective first opening.

6. The connector latch of claim 1 wherein said base portion comprises at least one latch member and said outer sleeve comprises at least one mating latch member, said at least one latch member engaging said at least one mating latch member when said inner sleeve is in said second position, and said at least one latch member disengaging said at least one mating latch member when said inner sleeve is in said first position.

7. The connector latch of claim 2 wherein said base portion includes at least one latch member and said outer sleeve comprises at least one mating latch member, said at least one latch member engaging said at least one mating latch member when said inner sleeve is in said second position, and said at least one latch member disengaging said at least one mating latch member when said inner sleeve is in said first position.

8. The connector latch of claim 7 wherein said at least one latch member comprises two latch members including one latch member positioned at an outer surface of said base portion adjacent a respective first opening, and another latch member positioned at an outer surface of said base portion adjacent another respective first opening, said one latch member being positioned opposite said another latch member relative to said longitudinal axis, and further wherein said at least one mating latch member comprises two mating latch members including one mating latch member aligned with said one latch member and another mating latch member aligned with said another latch member.

9. The connector latch of claim 8 wherein said one latch member and said another latch member each comprise a pair of detents including a first and second detent spaced for each other in a circumferential direction relative to said longitudinal axis, and further wherein said one mating latch member and said another mating latch member each comprise a pair of catch members including a first and second catch member spaced from each other in a circumferential direction relative to said longitudinal axis, each pair of catch members engaging and disengaging a respective pair of detents when said outer sleeve is in a second position and first position, respectively.

10. The connector latch of claim 1 wherein at least one leg of said plurality of legs includes a distal end having an outer surface which comprises a rib which extends away from said longitudinal axis, said outer sleeve being retained between said rib and said opposite second end.

11. A connector assembly comprising:

a connector latch comprising an inner member having a bore which extends therethrough along a longitudinal axis from a first end to an opposite second end, said inner member comprising a first segment and an opposite second segment, said opposite second segment comprising a base portion, said inner member comprising a plurality of first legs which extend in the direction of said longitudinal axis from said base portion towards said first end, at least one first leg of said plurality of first legs comprising a first protuberance which protrudes towards said longitudinal axis, said first protuberance being movable towards and away from said longitudinal axis, each first leg of said plurality of first legs being spaced from an adjacent first leg in a circumferential direction relative to said longitudinal axis to provide a respective first opening between adjacent legs; and an outer sleeve concentric with said inner member and having an inner surface adjacent an outer surface of said inner member, said outer sleeve being movable in the direction of said longitudinal axis towards and away from said protuberance to a first position and second position, respectively; and a first length of coaxial cable electrically and mechanically attached to a first connector and a second length of coaxial cable electrically and mechanically attached to a second connector, said second connector being electrically and mechanically connected to said first connector, said first connector comprising an abutment surface spaced from an end of said first connector, said end being adjacent said second connector, said first connector and said second connector extending into said bore of said inner member, and said protuberance being urged against said abutment surface by said outer sleeve positioned in said first position.

12. The connector assembly of claim 11 wherein said second connector comprises a plurality of lengths extending in an axial direction of said second connector, each length of said plurality of lengths being spaced from an adjacent length in a circumferential direction relative to said axial direction to provide spaces between adjacent lengths, said plurality of lengths being adjacent said end of said first connector, and further wherein said inner member comprises a plurality of second legs which extend in the direction of said longitudinal axis from said base portion towards said first end, each second leg of said plurality of second legs comprising a second protuberance which protrudes towards said longitudinal axis, each second protuberance being movable towards and away from said longitudinal axis, each second leg being positioned within a respective opening and each second protuberance extending into a respective space of said plurality of spaces.

13. The connector assembly of claim 11 wherein said plurality of first legs comprises two first legs including one first leg having one first protuberance and another first leg having another first protuberance, said one first protuberance being positioned opposite said another first protuberance relative to said longitudinal axis.

14. The connector assembly of claim 12 wherein said one first leg and said another first leg are pivotal relative to said base portion towards and away from said longitudinal axis to respectively move said one first protuberance and said another first protuberance towards and away from said longitudinal axis.

15. The connector assembly of claim 14 wherein said one first leg includes a first portion which extends in the direction of said longitudinal axis from said base portion away from said first end, and said another first leg includes a second portion which extends in the direction of said longitudinal axis from said base portion away from said first end, said first portion and said second portion being movable towards and away from said longitudinal axis to respectively pivot said one first protuberance and said another first protuberance away from and towards said longitudinal axis.

16. The connector assembly of claim 11 wherein said inner member further comprises a plurality of second legs which extend in the direction of said longitudinal axis from said base portion towards said first end, each second leg of said plurality of second legs comprising a second protuberance which protrudes towards said longitudinal axis, each second protuberance being movable towards and away from said longitudinal axis, each second leg being positioned within a respective first opening.

17. The connector assembly of claim 11 wherein said base portion includes at least one latch member and said outer sleeve comprises at least one mating latch member, said at least one latch member engaging said at least one mating latch member when said inner sleeve is in said second position, and said at least one latch member disengaging said at least one mating latch member when said inner sleeve is in said first position.

18. The connector assembly of claim 17 wherein said at least one latch member comprises two latch members including one latch member positioned at an outer surface of said base portion adjacent a respective first opening, and another latch member positioned at an outer surface of said base portion adjacent another respective first opening, said one latch member being positioned opposite said another latch member relative to said longitudinal axis, and further wherein said at least one mating latch member comprises two mating latch members including one mating latch member aligned with said one latch member and another mating latch member aligned with said another latch member.

19. The connector assembly of claim 18 wherein said one latch member and said another latch member each comprise a pair of detents including a first and second detent spaced for each other in a circumferential direction relative to said longitudinal axis, and further wherein said one mating latch member and said another mating latch member each comprise a pair of catch members including a first and second catch member spaced from each other in a circumferential direction relative to said longitudinal axis, each pair of catch members engaging and disengaging a respective pair of detents when said cylindrical member is in a second position and first position, respectively.

20. The connector assembly of claim 11 wherein at least one leg of said plurality of legs includes a distal end having an outer surface which comprises a rib which extends away from said longitudinal axis, said outer sleeve being retained between said rib and said opposite second end.

* * * * *